US009129471B2

(12) United States Patent
Chen et al.

(10) Patent No.: US 9,129,471 B2
(45) Date of Patent: Sep. 8, 2015

(54) 3D REELS

(71) Applicant: ARISTOCRAT TECHNOLOGIES AUSTRALIA PTY LIMITED, North Ryde, NSW (AU)

(72) Inventors: Sihua Chen, Henderson, NV (US); Linn McKay, Henderson, NV (US); Scott Stewart, Las Vegas, NV (US); Peter Mastera, Henderson, NV (US)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 0 days.

(21) Appl. No.: 14/065,066

(22) Filed: Oct. 28, 2013

(65) Prior Publication Data

US 2014/0057696 A1 Feb. 27, 2014

Related U.S. Application Data

(63) Continuation of application No. 13/240,261, filed on Sep. 22, 2011, now Pat. No. 8,574,054.

(60) Provisional application No. 61/385,393, filed on Sep. 22, 2010.

(51) Int. Cl.
*A63F 9/24* (2006.01)
*G07F 17/32* (2006.01)

(52) U.S. Cl.
CPC ..... *G07F 17/3213* (2013.01)

(58) Field of Classification Search
CPC ..... G07F 17/32
USPC ..... 463/16–20, 25–29
See application file for complete search history.

(56) References Cited

U.S. PATENT DOCUMENTS 5,211,399 A * 5/1993 Howard ..... 273/143 R
2008/0039181 A1* 2/2008 Loose et al. ..... 463/20

* cited by examiner

*Primary Examiner* — Omkar Deodhar
(74) *Attorney, Agent, or Firm* — McAndrews, Held & Malloy, Ltd.

(57) ABSTRACT

A mechanical reel (32) for a gaming system (10) is disclosed. The reel (32) has a circumferential reel surface (48). The reel (32) has at least one symbol bearing surface (50) offset from the reel surface.

12 Claims, 5 Drawing Sheets

3D REELS

RELATED APPLICATIONS

This application is a continuation of, and claims priority to, co-pending U.S. patent application Ser. No. 13/240,261, having a filing date of Sep. 22, 2011, which claims priority to U.S. Provisional Application No. 61/385,393 entitled "3D REELS" filed Sep. 22, 2010, both of which are incorporated herein by reference in their entirety.

BACKGROUND OF THE INVENTION

The present invention relates generally to gaming systems, and particularly but not exclusively to a mechanical reel and a reel strip having at least one offset symbol bearing surface.

Slot machines, otherwise known as fruit machines and poker machines typically have three or more reels which spin when a button is pushed. Each reel typically has printed on its outer surface a plurality of symbols. Each of the mechanical reels typically revolve and then stop to display a symbol. At full speed the reels may typically spin on the order of 100 revolutions per minute. At this speed it can be difficult to spot a symbol, such as a key or chaser symbol. While gaming systems provide players with enjoyment, a need exists for alternative gaming systems in order to maintain or increase player enjoyment.

BRIEF SUMMARY OF THE INVENTION

According to a first aspect of the invention there is provided a mechanical reel for a gaming system, the reel 30 comprising:

a circumferential reel surface; and an at least one symbol bearing surface offset from the reel surface.

An embodiment of a mechanical reel provides a unique look in comparison to the prior art. Having a chaser symbol, for example, offset from the reel surface may make it easier for a player to keep track of the passing symbol. This may maintain or increase player enjoyment. Some embodiments add a third dimension to an otherwise flat reel, in order to make a symbol literally stand out.

In an embodiment, the at least one symbol bearing surface is conspicuously offset from the reel surface.

In an embodiment, the symbol bearing surface is spaced from the reel surface so as to be offset from the reel surface.

The at least one symbol bearing surface may be spaced outwardly from the reel surface. Alternatively, the at least one symbol bearing surface may be spaced inwardly from the reel surface.

In an embodiment, the mechanical reel has an element that defines the position of the at least one symbol bearing surface relative to the reel surface. The element may define the orientation of the at least one symbol bearing surface relative to the reel surface.

In an embodiment, the reel surface has at least one aperture therein and the reel comprises a symbol carrier mounted within each aperture. The symbol carrier may comprise the symbol bearing surface. The carrier may be mounted such that the symbol bearing surface is offset at an angle relative to the reel surface.

In an embodiment, the mechanical reel comprises a plurality of symbols, at least one symbol of the plurality of symbols disposed on the symbol bearing surface and the remainder of the symbols disposed on the reel surface.

In an embodiment, the mechanical reel comprises a strip of looped material and the reel surface is a surface of the strip. The strip of looped material may be a reel strip.

In an embodiment, at least a portion of the symbol bearing surface is tilted with respect to an adjacent part of the reel surface.

According to a second aspect of the invention there is provided a mechanical reel for a gaming system, the reel comprising:

a circumferential reel surface having at least one aperture therein; and a symbol carrier mounted relative to each aperture so as to be movable relative to the aperture, the symbol carrier comprising at least one symbol bearing surface carrying a symbol which is visible in at least one orientation of the symbol carrier.

In an embodiment, the symbol carrier is pivotally mounted so as to be able to spin within the aperture.

In an embodiment, the symbol carrier is mounted by a hinge to the reel.

According to a third aspect of the invention there is provided a reel strip for a gaming system, the reel strip comprising:

a circumferential reel strip surface; and an at least one symbol bearing surface offset from the reel strip surface.

In an embodiment, the at least one symbol bearing surface is conspicuously offset from the reel strip surface. The at least one symbol bearing surface may be spaced outwardly from the reel strip surface. Alternatively, the at least one symbol bearing surface may be spaced inwardly from the reel strip surface.

In an embodiment, at least a portion of the symbol bearing surface is tilted with respect to an adjacent part of the reel strip surface.

According to a fourth aspect of the invention there is provided a gaming system comprising at least one mechanical reel in accordance with either one of the first and second aspects.

According to a fifth aspect of the invention there is provided a gaming system comprising at least one reel strip in accordance with the third aspect of the invention.

BRIEF DESCRIPTION OF SEVERAL VIEWS OF THE DRAWINGS

Features and advantages of the present invention will become apparent from the following description of embodiments thereof, by way of example only, with reference to the accompanying drawings, in which.

DETAILED DESCRIPTION OF THE INVENTION

Figure 1:
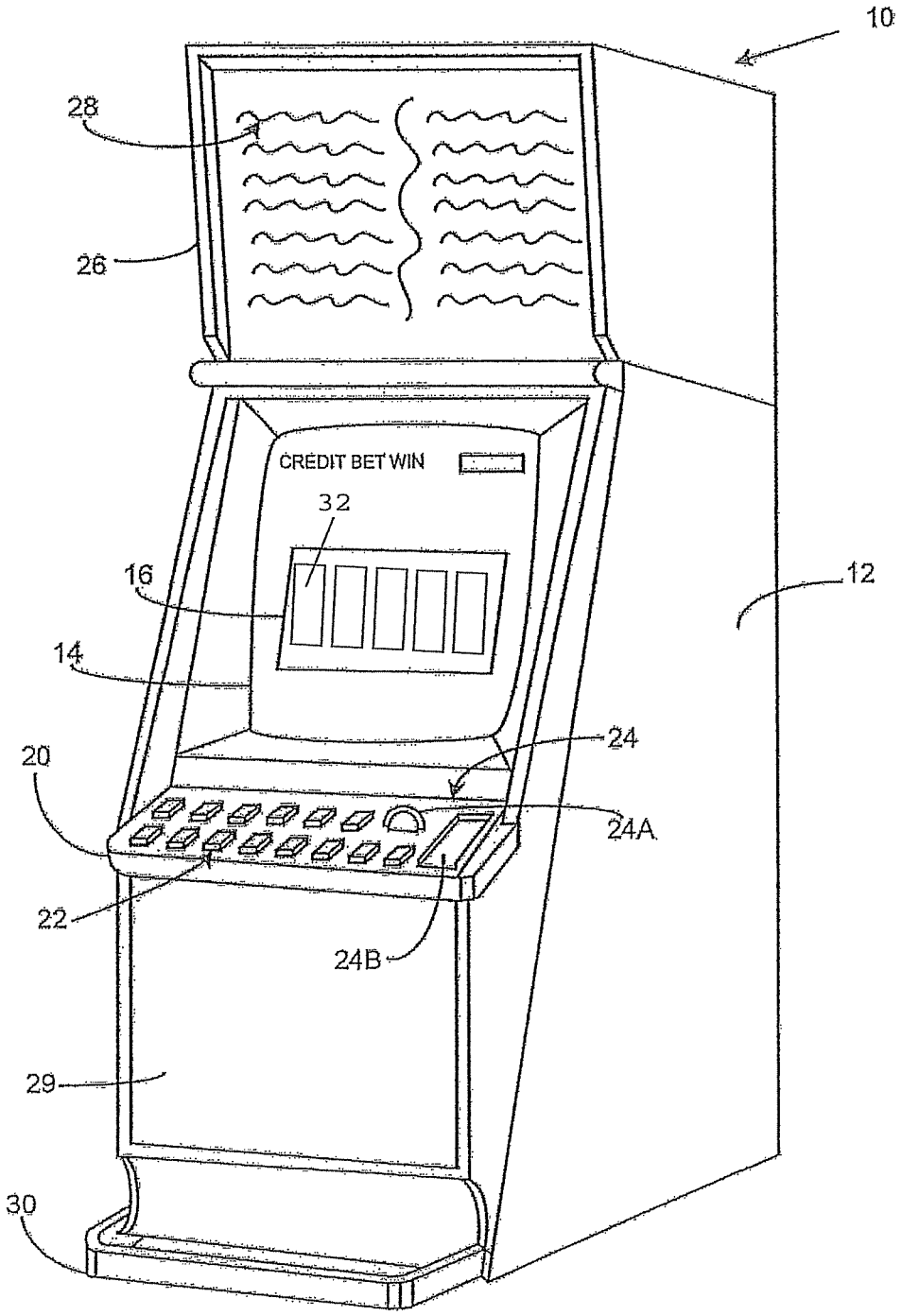
FIG. 1 shows a perspective view of a gaming system in the form of a stand alone gaming machine.

FIG. 1 shows a perspective view of a gaming system in the form of a stand alone gaming machine 10. The gaming machine 10 includes a console 12 having a plurality of mechanical reels such as 16 that can be played by a player.

Figure 2:
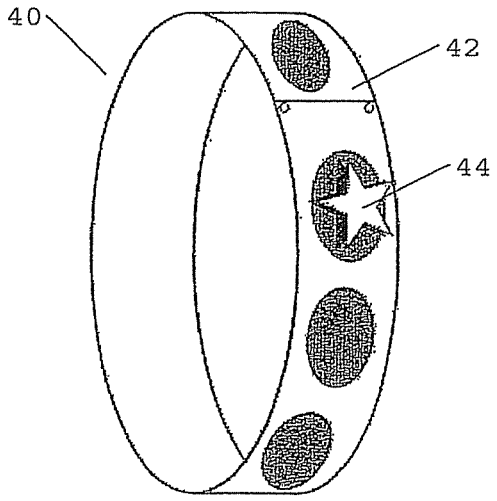
FIG. 2 shows a perspective view of one embodiment of a strip of looped material forming a reel strip.

FIG. 2 shows a perspective view of one embodiment of a strip of looped material forming a reel strip generally indicated by the numeral 40. In use, the strip is disposed on at least one of the mechanical reels 32 used in the gaming system shown in FIG. 1. The reel strip 40 has a circumferential reel strip surface 42, and an at least one symbol bearing surface 44 offset from the reel strip surface. The reel strip has, in this but necessarily in all embodiments, a plurality of symbols. At least one of the plurality of symbols is disposed on the symbol bearing surface and the remainder of the symbols are disposed on the reel strip surface. The offset is such that the symbol bearing surface is conspicuous with respect to the reel surface to a player of the gaming system 10, although it need not be in all embodiments. In the embodiment of FIG. 2, the symbol bearing surface is spaced outwardly from the reel surface by an element 56, but it need not in all embodiments. In this embodiment, the symbol bearing surface has a star shaped perimeter, but the perimeter does not need to be any particular shape.

Figure 3:
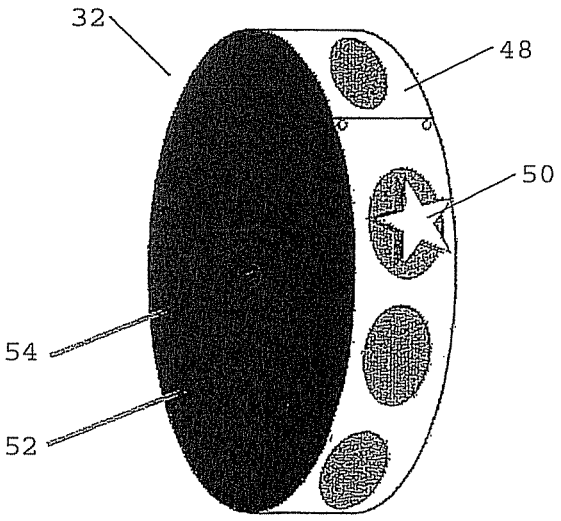
FIG. 3 shows a perspective view of a mechanical reel.

FIG. 3 shows a perspective view of a mechanical reel 32 of the gaming system 10 of FIG. 1 with the reel strip of FIG. 2 disposed thereon.

When the reel strip is so disposed on the reel 32, there is provided a mechanical reel having a circumferential reel surface 48, which is the surface 42 of the strip, and an at least one symbol bearing surface 50 offset from the reel surface 48. The symbol bearing surface 50, in this embodiment, is that of the strip 44. In the embodiment of FIG. 3, the reel body 52 has a central aperture 54 for mounting of the reel 32 on an axle for imparting a rotational motion to the reel.

The reel strip may be formed of any combination of laminated layers of paper, plastic, and printed film paper, for example. Generally, any suitable material may be used and construction employed. The strips may have silk screen art, such as the symbols. The silk screened symbols may control light that illuminates the symbol from behind. The strip may include at least a transparent portion, or other means to make the symbol stand out.

Figure 4:
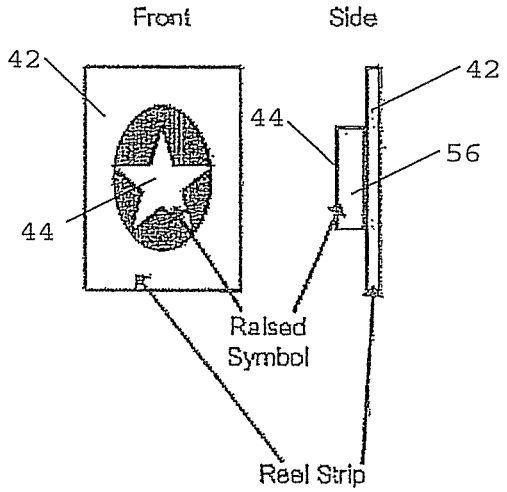
FIG. 4 shows a front and an elevation side view of the portion of the reel strip of FIG. 2.

FIG. 4 shows a front and an elevation side view of the portion of the reel strip of FIG. 2. The strip portion has an element 56 positioned intermediate the strip surface 42 and the symbol bearing surface 44. The element 56 defines the position of the symbol bearing surface relative to the reel surface. In this embodiment, the symbol is formed on one face 44 of the element 56 having an opposing face which is then fastened to the reel surface 42.

The embodiment of FIG. 4 has a symbol bearing surface that is orientated by the element 56 to be tangential to the adjacent reel strip surface. Any suitable means of orientation may be employed. The element may be integrally formed with one or both of the reel and symbol bearing surfaces.

Figure 5:
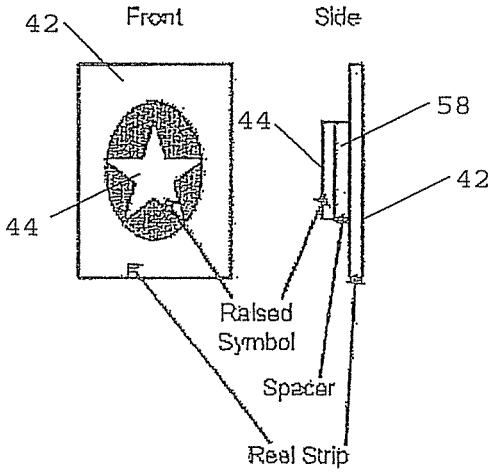
FIG. 5 shows a front and an elevation side view of a portion of another embodiment of a reel strip.

FIG. 5 shows a front and an elevation side view of a portion of another embodiment of a reel strip, in which similar parts are similarly numbered. In the embodiment of FIG. 5, the element 58 is formed separately to one and/or both of the reel strip and symbol bearing surfaces and then subsequently fastened by an adhesive or any other suitable fastening means. The element 58 may be formed of, for example, a molded polymer, foam tape, embossed paper, or any suitable material.

Figure 6:
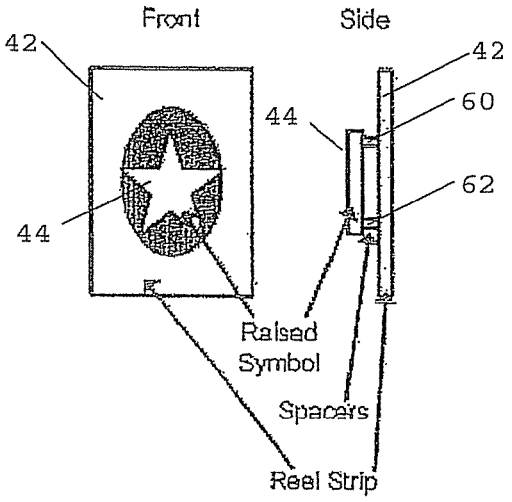
FIG. 6 shows a front and an elevation side view of a portion of another embodiment of a reel strip.

FIG. 6 shows a front and an elevation side view of a portion of another embodiment of a reel strip, in which similar parts are similarly numbered. In the embodiment of FIG. 6, the element is one of two elements 60,62 in the form of legs extending between the rear of the symbol bearing surface and the reel strip surface.

Figure 7:
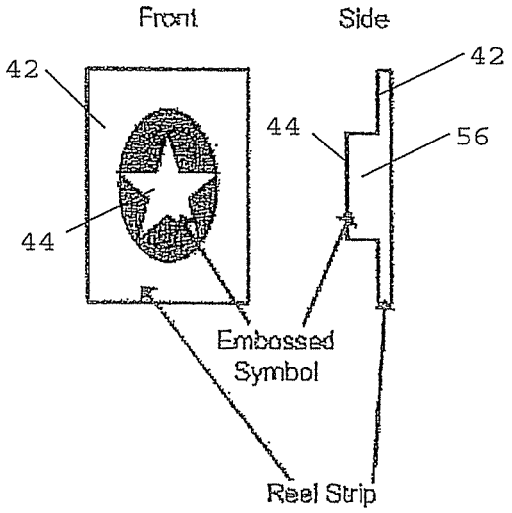
FIG. 7 shows a front and an elevation side view of a portion of another embodiment of a reel strip.

FIG. 7 shows a front and an elevation side view of a portion of another embodiment of a reel strip, in which similar parts are similarly numbered. In the embodiment of FIG. 7, the element 56, the strip surface 42 and the symbol bearing surface are integrally formed and contiguous.

Figure 8:
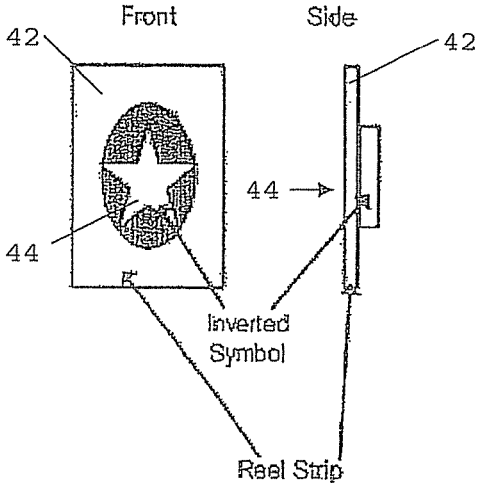
FIG. 8 shows a front and an elevation side view of a portion of another embodiment of a reel strip.

FIG. 8 shows a front and an elevation side view of a portion of another embodiment of a reel strip, in which similar parts are similarly numbered. In the embodiment of FIG. 8, the symbol bearing surface 44 is spaced inwardly from the reel surface 42 to give a sunken impression. In this particular embodiment, the symbol is inverted.

Figure 9:
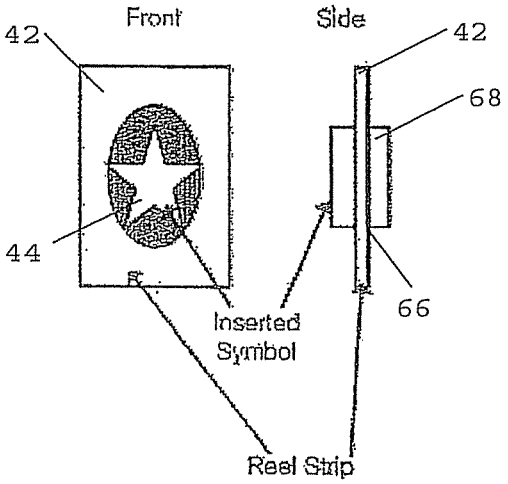
FIG. 9 shows a front and an elevation side view of a portion of another embodiment of a reel strip.

FIG. 9 shows a front and an elevation side view of a portion of another embodiment of a reel strip, in which similar parts are similarly numbered. In the embodiment of FIG. 9, the reel surface 42 has at least one aperture 66 therein and the reel comprises a symbol carrier 68 mounted within each aperture. The symbol carrier 68 comprising the symbol bearing surface and is mounted such that the symbol bearing surface is offset relative to the reel surface.

The additional mass on the perimeter of the reel should not cause any problems with the reel spin, but if necessary it could be counter-balanced by another such symbol on the opposite side of the reel.

Figure 10:
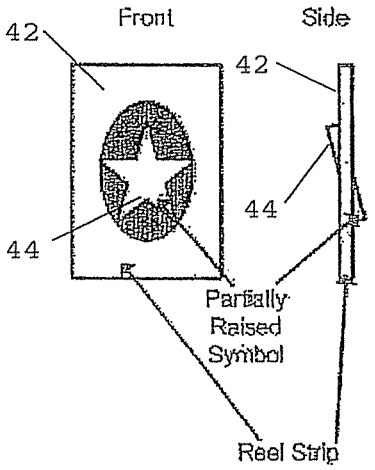
FIG. 10 shows a front and an elevation side view of a portion of another embodiment of a reel strip.
Figure 11:
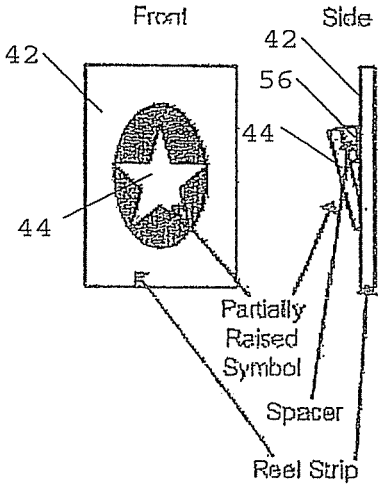
FIG. 11 shows a front and an elevation side view of a portion of another embodiment of a reel strip.

FIG. 10 shows a front and an elevation side view of a portion of another embodiment of a reel strip, in which similar parts are similarly numbered. In the embodiment of FIG. 10, the symbol bearing surface 44 is tilted with respect to an adjacent part of the reel surface 42.

Figure 12:
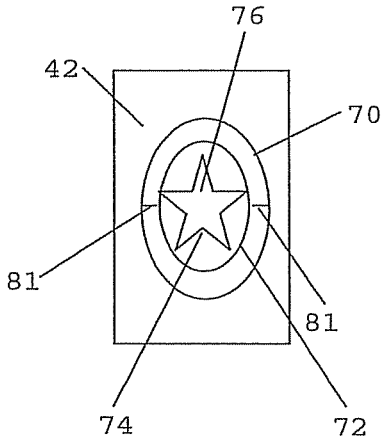
FIG. 12 shows a front view of a portion of a circumferential surface of an embodiment of a reel.

FIG. 12 shows a front view of a portion of a circumferential surface 42 of another embodiment of a reel. In the embodiment of FIG. 12, the circumferential reel surface 42 has at least one aperture 70. A symbol carrier 72 in the form of a ball, for example, is mounted relative to the aperture 70 so as to be movable relative to the aperture 70. The symbol carrier has a symbol bearing surface 74 carrying a symbol 76 which is visible in at least one orientation of the symbol carrier. The symbol carrier 72 is pivotally mounted on a rod or axle 81 so as to be able to spin within the aperture 79.

Figure 13:
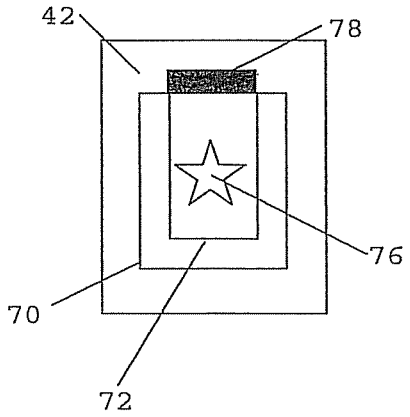
FIG. 13 shows a front view of a portion of a circumferential surface 42 of another embodiment of a reel.

FIG. 13 shows a front view of a portion of a circumferential surface 42 of another embodiment of a reel. Similar to the embodiment of FIG. 12, the symbol carrier is 'free floating' in an aperture, however the symbol carrier in this embodiment is mounted by a hinge 78 to the reel surface. In another embodiment, the symbol carrier is attached to the reel surface by, for example, a flexible member such as a thread, strip of resilient material such as rubber, etc.

It will be appreciated that not all embodiments have a reel strip disposed on the reel, and any suitable reel construction may be employed. For example, the reel may be injection molded, the offset surface 50 integrally formed with a reel body 52. The symbol may be molded into the surface. Alternatively or additionally, the symbol may be printed on the surface 50 subsequent to forming the reel, a sticker having the symbol may be applied to surface 50, or the symbol may be embossed on the surface. Generally, the symbol may be caused to be disposed on the surface by any suitable means during or subsequent to formation of the reel.

A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts for the gaming machine 10.

It will be understood to persons skilled in the art of the invention that many modifications may be made without departing from the spirit and scope of the invention.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A mechanical reel for a gaming system, the reel comprising:

a circumferential reel surface; and at least one symbol bearing surface offset from the reel surface, wherein the at least one symbol bearing surface is spaced 1) from the reel surface so as to be offset from the reel surface, and 2) inverted from the circumferential reel surface to give a sunken impression when viewed from the circumferential reel surface.

2. A mechanical reel defined by claim 1, and further having an element that defines the position of the at least one symbol bearing surface relative to the reel surface.

3. A mechanical reel defined by claim 2 wherein the element defines the orientation of the at least one symbol bearing surface relative to the reel surface.

4. A mechanical reel as claimed in claim 1, and wherein the reel surface has at least one aperture therein and the reel comprises a symbol carrier mounted within each aperture, the symbol carrier comprising the symbol bearing surface and being mounted such that the symbol bearing surface is offset at an angle relative to the reel surface.

5. A mechanical reel as claimed in claim 1, and further comprising a plurality of symbols, at least one symbol of the plurality of symbols disposed on the symbol bearing surface and the remainder of the symbols disposed on the reel surface.

6. A mechanical reel as claimed in claim 1, and further comprising a strip of looped material and the reel surface is a surface of the strip.

7. A mechanical reel refined by claim 6, and wherein the strip of looped material is a reel strip.

8. A mechanical reel as claimed in claim 1, and wherein at least a portion of the at least one symbol bearing surface is tilted with respect to an adjacent part of the reel surface.

9. A mechanical reel as claimed in claim 1, and further including a gaming system, said mechanical reel forming part of said gaming system.

10. A reel strip for a gaming system, the reel strip comprising:

a circumferential reel strip surface; and at least one symbol bearing surface offset from the reel strip surface;

wherein the symbol bearing surface is spaced 1) from the reel surface so as to be offset from the reel surface, and 2) inverted from the reel surface to give a sunken impression when viewed from the reel surface.

11. A reel strip as claimed in claim 10, and wherein at least a portion of the at least one symbol bearing surface is tilted with respect to an adjacent part of the reel strip surface.

12. A reel strip as claimed in claim 10, and further including a gaming system, said reel strip forming part of said gaming system.

* * * * *